US010116034B2

(12) United States Patent
Badehi et al.

(10) Patent No.: US 10,116,034 B2
(45) Date of Patent: Oct. 30, 2018

(54) TWIN AXIAL CABLE STRUCTURES FOR TRANSMITTING SIGNALS

(71) Applicant: MELLANOX TECHNOLOGIES, LTD., Yokneam (IL)

(72) Inventors: Pierre Avner Badehi, Yehuda (IL); Eyal Frost, Balfuria (IL)

(73) Assignee: Mellanox Technologies, Ltd., Yokneam (IL)

( * ) Notice: Subject to any disclaimer, the term of this patent is extended or adjusted under 35 U.S.C. 154(b) by 294 days.

(21) Appl. No.: 14/860,166

(22) Filed: Sep. 21, 2015

(65) Prior Publication Data

US 2017/0084973 A1 Mar. 23, 2017

(51) Int. Cl.

*H01P 11/00* (2006.01)
*H01P 3/06* (2006.01)
*H01P 3/02* (2006.01)

(52) U.S. Cl.

CPC ..... *H01P 11/005* (2013.01); *H01P 3/026* (2013.01); *H01P 3/06* (2013.01)

(58) Field of Classification Search

CPC ..... H01B 13/008; H01P 11/00; H01P 3/04; H01P 3/02; H01P 11/005; H01P 3/026; H01P 3/06; H05K 1/0245

(Continued)

(56) References Cited

U.S. PATENT DOCUMENTS 3,663,739 A 5/1972 Chevrier
4,234,759 A * 11/1980 Harlow ..... H01B 7/0838 174/103
7,151,420 B2 * 12/2006 Brunker ..... H01P 3/023 333/4

FOREIGN PATENT DOCUMENTS

CN 1620716 5/2005
CN 1902990 1/2007

(Continued)

OTHER PUBLICATIONS

Mellanox Technologies: "Interconnect Ovierview", [online] [retrieved Oct. 7, 2015] <URL: http://www.mellanox.com/page/interconnect_overview> 2 pages.

(Continued)

*Primary Examiner* — Rakesh Patel
*Assistant Examiner* — Jorge Salazar, Jr.
(74) *Attorney, Agent, or Firm* — Alston & Bird LLP

(57) ABSTRACT

A twin axial cable structure is provided for transmitting signals that makes use of insulative materials that are not easily extruded, such as expanded polyethylene (ePE) and expanded polytetrafluoroethylene (ePTFE). The cable structure includes an insulative body portion having a pair of open channels defined through an outer longitudinal surface of the insulative body portion, in which are disposed a pair of conductive wires. A conductive sheet is disposed on the insulative body portion, and a grounding element is placed in contact with the conductive sheet, such as by applying planar conductive sheets and grounding elements and/or ground wires to the insulative body portion. Corresponding methods and apparatuses for manufacturing the same are also provided. The cable structures, methods, and apparatuses described herein can produce a cable structure for transmitting multiple differential signals within the same structure, with minimal negative effects on other, neighboring transmissions.

12 Claims, 10 Drawing Sheets

(58) Field of Classification Search
USPC ..... 29/868; 333/1, 4, 5, 12, 236, 238, 246;
174/117 F; 156/47
See application file for complete search history.

(56) References Cited

FOREIGN PATENT DOCUMENTS

| | | |
|---|---|---|
| CN | 204178750 | 2/2015 |
| CN | 204229885 | 3/2015 |

OTHER PUBLICATIONS

Office Action for Chinese Office Action No. 201610835836.2 dated Jul. 3, 2018, 7 pages.

* cited by examiner

TWIN AXIAL CABLE STRUCTURES FOR TRANSMITTING SIGNALS

BACKGROUND

The present disclosure relates in general to cable structures for transmitting signals, and more particularly to cable structures for transmitting differential signals that are made with insulating materials that are not extruded.

In the current age, there has been an ever increasing need to transfer information at high rates. At the same time, there is a desire to achieve better signal quality by minimizing signal losses, such as due to attenuation, cross-talk, and skin effect.

Information in the form of electronic signals can be transmitted from one point (e.g., a source) to another (e.g., a receiver) in many different ways, and each technique has its advantages and disadvantages. In differential signaling, for example, two conductors are used to carry complementary signals, and it is the electrical difference between the two signals that carries the information being transmitted. The two conductors are conventionally surrounded by an extruded insulative material and bundled together, either as a twisted pair or in a twin axial configuration.

Balancing consumer needs for high speed and high quality signals are manufacturing considerations, which affect the types of materials that can be used and the resulting cost of the cable structures.

BRIEF SUMMARY

Embodiments of the invention described herein therefore provide improved cable structures for transmitting signals, and particularly twin axial cable structures that make use of insulative materials that are not easily extruded, such as expanded polyethylene (ePE), polytetrafluoroethylene (PTFE), and expanded polytetrafluoroethylene (ePTFE). Because embodiments of the cable structures described herein are formed without the use of extrusion processes, conventionally non-extrudable materials including ePE, PTFE, and ePTFE can be used to reduce signal losses and enhance the resulting signal quality of the transmitted differential signals. Moreover, the cable structures, methods, and apparatuses for manufacturing the cable structures described herein can produce a cable structure for transmitting multiple differential signals within the same structure, with minimal negative effects on other, neighboring transmissions.

Accordingly, in some embodiments, a cable structure for transmitting a differential signal is provided. The cable structure comprises an insulative body portion defining a pair of open channels and a pair of conductive wires disposed within the pair of open channels. The channels are parallel to each other and extend a length of the insulative body portion, and each channel is defined through an outer longitudinal surface of the insulative body portion and extends through opposite ends of the insulative body portion. The pair of conductive wires is configured to collectively transmit a differential signal. The cable structure further comprises a conductive sheet disposed on the insulative body portion and configured to shield the pair of conductive wires, and a grounding element in contact with the conductive sheet and configured to conduct electric current away from the conductive sheet. The insulative body portion may comprise polyethylene, polytetrafluoroethylene, expanded polyethylene, or expanded polytetrafluoroethylene.

In some embodiments, each open channel may be defined by cutting through the outer longitudinal surface of the insulative body portion. Moreover, a pair of channel caps may be disposed within the pair of open channels, respectively, so as to enclose and maintain the pair of conductive wires within the respective open channels. Each channel cap may be configured to engage the respective open channel via a friction fit and/or each channel cap may comprise a polymer non-conductive wire.

In some cases, the conductive sheet may be wrapped around the insulative body portion, and the grounding element may be disposed against an outer surface of the conductive sheet. In other cases, the grounding element may be disposed against an outer surface of the insulative body portion and the conductive sheet may be wrapped around the insulative body portion and the grounding element. The conductive sheet may, in some embodiments, comprise at least one of an aluminum foil, a copper foil, or a conductive metal-coated polymer film. In still other embodiments, the grounding element may comprise at least one ground wire.

In some cases, the conductive sheet may comprise a first planar conductive sheet disposed on a first side of the insulative body portion and a second planar conductive sheet disposed on a second side of the insulative body portion, opposite the first side. The grounding element may comprise a first grounding element disposed on an outer surface of the first planar conductive sheet and a second grounding element disposed on an outer surface of the second planar conductive sheet, opposite the outer surface of the first planar conductive sheet. Additionally, in some embodiments, the insulative body portion may define two pairs of open channels comprising a central pair of open channels and an outer pair of open channels, and the conductive wires may be disposed in the central pair of open channels. The cable structure may further comprise first and second ground wires disposed in the outer pair of open channels, such that the first ground wire is disposed on one side of the pair of conductive wires and second ground wire is disposed on the other side of the pair of conductive wires. The insulative body portion may, in some cases, define a plurality of pairs of open channels, and each two pairs of open channels may comprise a central pair of open channels and an outer pair of open channels having conductive wires and first and second ground wires disposed therein, respectively.

In other embodiments, a method of manufacturing a cable structure for transmitting a differential signal is provided. According to embodiments of the method, a pair of open channels is cut through an outer longitudinal surface of a ribbon of material to form an insulative body portion, where the channels are parallel to each other and extend a length of the insulative body portion. A pair of conductive wires is inserted within the pair of open channels, where the pair of conductive wires is configured to collectively transmit a differential signal. A conductive sheet is disposed on the insulative body portion, and the conductive sheet is configured to shield the pair of conductive wires. A grounding element is placed in contact with the conductive sheet, the grounding element being configured to conduct electric current away from the conductive sheet.

In some cases, the pair of conductive wires may be enclosed within the pair of open channels by placing a pair of channel caps into the pair of open channels. Additionally, disposing the conductive sheet on the insulative body portion may comprises wrapping the conductive sheet around the insulative body portion, and placing the grounding element in contact with the conductive sheet may comprises disposing the grounding element against an outer surface of the conductive sheet. Alternatively, placing the grounding element in contact with the conductive sheet may comprise disposing the grounding element against an outer surface of the insulative body portion, and disposing the conductive sheet on the insulative body portion may comprise wrapping the conductive sheet around the insulative body portion and the grounding element.

In some cases, disposing the conductive sheet may comprise adhering a first planar conductive sheet onto a first side of the insulative body portion and adhering a second planar conductive sheet onto a second side of the insulative body portion, opposite the first side. Placing the grounding element may comprise applying a first grounding element onto an outer surface of the first planar conductive sheet and applying a second grounding element onto an outer surface of the second planar conductive sheet, opposite the outer surface of the first planar conductive sheet.

In some embodiments, cutting a pair of open channels may comprise cutting two pairs of open channels comprising a central pair of open channels and an outer pair of open channels, and inserting a pair of conductive wires may comprise inserting a pair of conductive wires in the central pair of open channels. The method may further comprise inserting first and second ground wires in the outer pair of open channels, such that the first ground wire is disposed on one side of the pair of conductive wires and the second ground wire is disposed on the other side of the pair of conductive wires. In some cases, cutting a pair of open channels may comprise cutting a plurality of pairs of open channels comprising central pairs of open channels and outer pairs of open channels, and inserting a pair of conductive wires may comprise inserting a pair of conductive wires in each central pair of open channels. The method may further comprise inserting first and second ground wires in each outer pair of open channels, such that each first ground wire is disposed on one side of a respective pair of conductive wires and each second ground wire is disposed on the other side of the respective pair of conductive wires.

In still other embodiments, an apparatus for manufacturing a cable structure for transmitting a differential signal is provided. The apparatus may comprise a first spool configured to hold a supply of ribbon, a second spool configured to support a portion of the ribbon received from the first spool, a cutting element, and a third spool downstream of the second spool. The cutting element may be configured to cut a pair of open channels through an outer longitudinal surface of the portion of the ribbon supported by the second spool to form an insulative body portion of a cable. The cutting element may, in some cases, comprise two or more rotary cutting blades supported by a motor shaft. The third spool may be configured to provide a supply of conductive wire, such that a pair of conductive wires is inserted within the pair of open channels of the insulative body portion.

In some cases, the apparatus may further comprise a tensioning element configured to apply tension to a portion of the ribbon received from the second spool, where the amount of tension applied to the portion of the insulative ribbon facilitates insertion of the pair of conductive wires within the pair of open channels. In addition, in some cases, the apparatus may include a fourth spool configured to provide a supply of channel caps for insertion within the pair of open channels of the insulative body portion, respectively, following insertion of the pair of conductive wires, so as to enclose and maintain the pair of conductive wires within the respective open channels.

In some embodiments, the apparatus may comprise a coating station downstream of the second spool configured to apply a protective surface to the insulative body portion following insertion of the pair of conductive wires.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. It is noted that although the terms "left," "right," "front," "rear," "top," and "bottom" are used in the description herein to refer to certain parts of the cable structure and components thereof, such terms are used for ease of explanation only.

As noted above, conventional differential signaling techniques use two conductors to carry complementary signals (e.g., one positive, one negative), such that a receiving circuit responds to the electrical difference between the two signals. Differential signaling may be accomplished using a twisted pair configuration (e.g., screened twisted pair, or STP), in which the two conductors are twisted about each other, or a twin axial configuration (e.g., twinax).

Conventional differential signaling techniques provided several advantages over other signaling techniques in the early days of computers and communication networks, such as in terms of manufacturing costs, stability of the signal being transmitted, and noise resiliency. The most recent implementations of differential signaling, however, favor the use of twin-axial cables for very high frequency networks (e.g., approximately 25 GHz to 400 GHz).

Conventional twin-axial cables may, for example, be adapted for 100 Gbit/s Ethernet connectivity applications in data centers, enterprise wiring closets, and service provider transport applications and may provide a cost-effective way to make connections within racks and across adjacent racks. For example, twin-axial cables may be used between a server and the top of a rack switch. Individual pairs of twin-axial cables may also be bundled together in multi-pair configurations, and these conventional cables may be able to handle short distances with speeds up to 100 Gbit/s.

Figure 1:
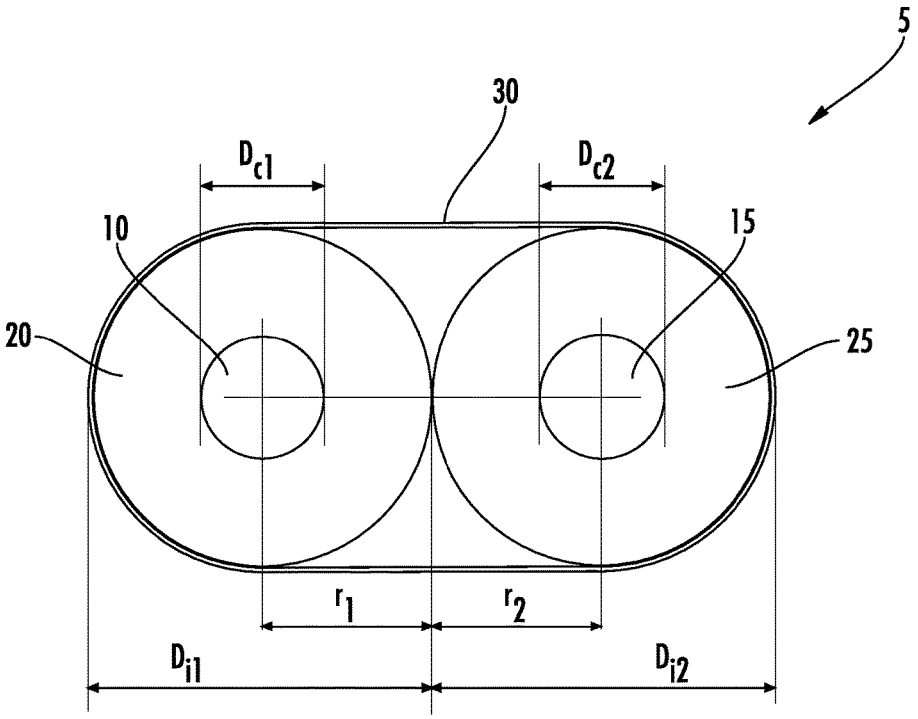
FIG. 1 is an illustration of a cross-section of a twin axial cable according to conventional extrusion techniques.

Both STP and twin-axial cables are common today, and there is still a high interest in enhancing their performance, such as by further optimizing the cable design dimensions and using low-loss materials to positively influence cable signal propagation properties With reference to FIG. 1, traditional twin-axial cables 5 include a pair of conductors 10, 15, such as made of copper wire, with an insulator 20, 25 surrounding each conductor and separating the conductors from each other. A metallic foil screen 30 is disposed around the two conductors 10, 15 and their respective insulators 20, 25, which are typically manufactured in extrusion lines. In some cases, one or more drains or grounding wires (not shown) may be placed in contact with the screen 30, as well. The diameter of each conductor 10, 15, denoted by $D_{c1}$ and $D_{c2}$ in FIG. 1, and the diameter of each insulator 20, 25, denoted by $D_{i1}$ and $D_{i2}$, together define a distance ($r_1$+$r_2$) between the two conductors, which is an important parameter influencing the impedance and signal loss of the given cable 5. In particular, any changes in the distance ($r_1$+$r_2$) as the signal pair is propagated over the length of the cable 5 may cause an increase in the noise that is experienced and may reduce the signal transmission efficacy.

In addition to the dimensional aspects of the cable 5, material selection also has an effect on signal quality. For example, the material used to make the insulator 20, 25 ideally should, at high frequencies, have minimal effect on the transmission efficacy of the signal propagated through the conductor. The transmission efficacy of the signal may be affected, for example, when the energy of the signal is dissipated as heat due to resonance at the molecular level. In conventional cables 5, polyethylene (PE) is typically chosen as the insulator 20, 25 because it exhibits good high frequency properties due to its low dielectric constant K (K of approximately 2.5) and low dissipation factor and can be extruded to form the cable according to conventional manufacturing methods. Other materials, such as polytetrafluoroethylene (PTFE), may be desirable for use as the insulator 20, 25 due to a low dielectric constant K (K of approximately 2.2 for PTFE) and low dissipation factor. In the case of PTFE, however, this material is more difficult to extrude than, for example, PE and is thus harder to manufacture. Moreover, materials that have even lower dielectric constants K, such as expanded PE (ePE), which is produced by applying heat, pressure, and a blowing agent to PE in the extrusion melt phase to create voids in the material and has a dielectric constant K of approximately 1.5, and expanded PTFE (ePTFE), which is produced by applying heat and quickly pulling the material to create voids and has a dielectric constant K of approximately 1.3, are even more difficult, if not impossible, to use for manufacturing a cable according to conventional methods.

Accordingly, embodiments of the invention described herein replace the currently available complex extrusion process for forming a cable with a simpler, continuous assembly process that produces an accurately dimensioned, parallel pair transmission line that can make use of insulative materials that are very hard, if not impossible, to form into cables through conventional manufacturing processes, such as extrusion processes.

Figure 2:
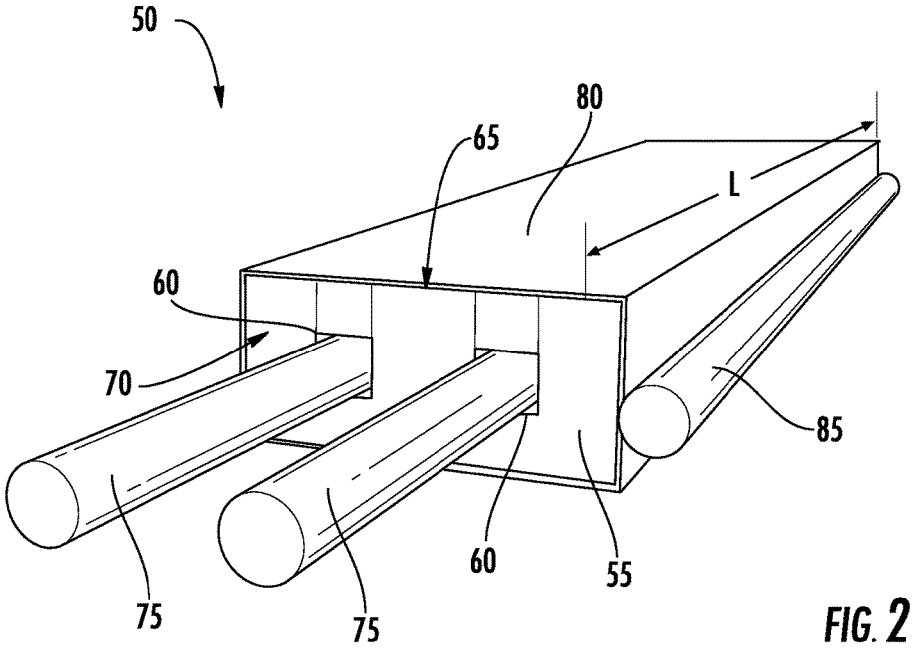
FIG. 2 is a perspective view of a cable structure according to an example embodiment.

With reference now to FIG. 2, a cable structure 50 for transmitting a differential signal is illustrated according to an embodiment of the invention. The cable structure 50 includes an insulative body portion 55 that defines a pair of open channels 60. The channels 60 are parallel to each other and extend a length L of the insulative body portion 55. In this regard, each channel 60 is defined through an outer longitudinal surface 65 of the insulative body portion 55 and extends through opposite ends 70 of the insulative body portion.

A pair of conductive wires 75 are disposed within the pair of open channels 60. The pair of conductive wires 75 is configured to collectively transmit a differential signal through the cable structure 50, such as from one end of the cable structure (e.g., at a source) to the other end (e.g., at a receiver). A conductive sheet 80 may be disposed on the insulative body portion 55, as described in greater detail below, where the conductive sheet is configured to shield the pair of conductive wires 75, and a grounding element 85 may be provided that is in contact with the conductive sheet 80 and is configured to conduct electric current away from the conductive sheet.

According to embodiments of the invention, the cable structure 50 is not extruded (e.g., the insulative body portion 55 is not extruded, although other components may be separately extruded and applied to the insulative body portion to form the cable structure, as described in greater detail below). Rather, each open channel 60 may, for example, be defined by cutting through the outer longitudinal surface 65 of the insulative body portion 55. Because the insulative body portion 55 is not formed using an extrusion process, materials that are difficult or impossible to extruded can now be used to manufacture the cable structure according to the embodiments described herein. For example, the insulative body portion 55 may comprise polyethylene (PE), polytetrafluouroethylene (PTFE), expanded polyethylene (ePE), or expanded polytetrafluoroethylene (ePTFE), or any other insulative material that is both flexible and has a low dielectric constant and a low dissipation factor. The approximate dielectric constant and dissipation factor for PE, PTFE, ePE, and ePTFE are provided in Table 1 below for reference.

TABLE 1

| | PE | ePE | PTFE/low density PTFE | ePTFE |
|---|---|---|---|---|
| Dielectric constant (K) | 2.3 | 1.55 | 2.2/1.7 | 1.3 |
| Dissipation factor (DF) | $300e^{-6}$ | $200e^{-6}$ | $220e^{-6}/50e^{-6}$ | $50e^{-6}$ |

Figure 3:
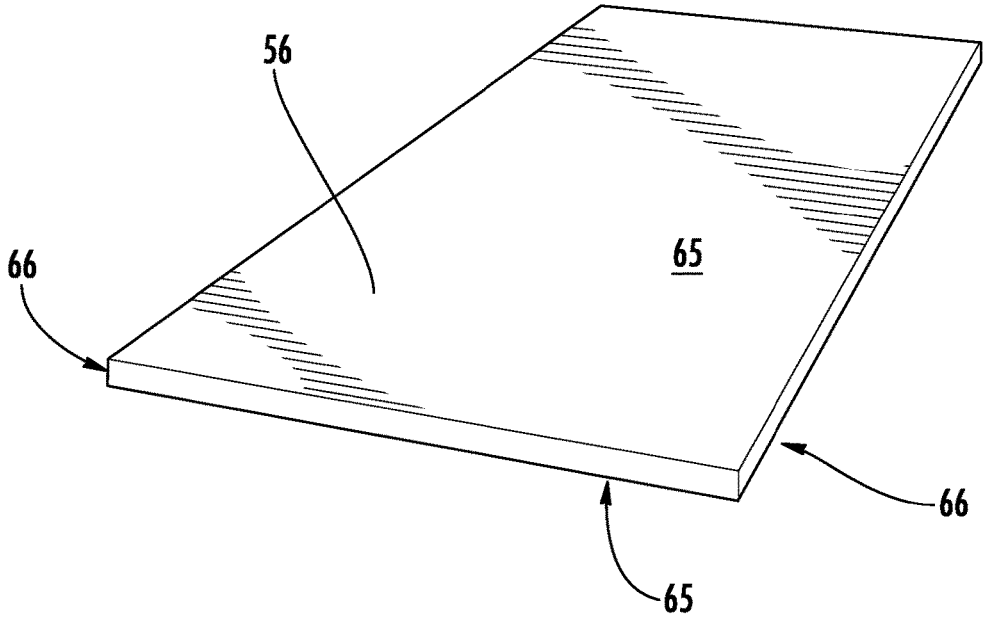
FIG. 3 is a perspective view of a ribbon of material for forming an insulative body portion of a cable structure according to an example embodiment.

With reference to FIG. 3, for example, a ribbon of material 56 may be provided having a rectangular cross-section including two outer longitudinal surfaces 65 and two lateral surfaces 66. In FIG. 3, the ribbon of material 56 is shown as lying flat; however, the ribbon may be rolled on a spool or stored in any other suitable form, such that no folds, scratches, or other dimensional changes to the ribbon are introduced (e.g., such that the physical integrity and shape of the ribbon are maintained). In this regard, some materials selected for the ribbon of material 56 that will eventually form the insulative body portion 55 of FIG. 2 may be porous and/or otherwise delicate and susceptible to creasing and scratching, which would change the structure and dimensions of the ribbon and negatively affect the quality of the resulting cable structure to be formed.

Figure 4:
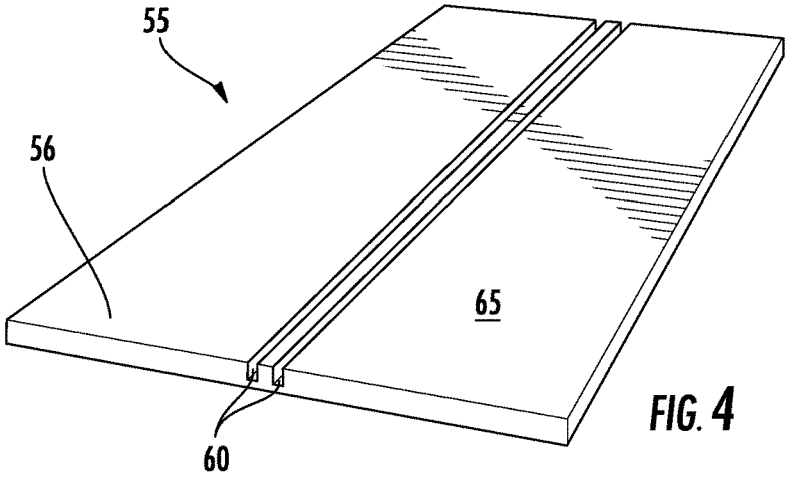
FIG. 4 is a perspective view of the ribbon of FIG. 3 showing a pair of open channels formed therein according to an example embodiment.
Figure 4A:
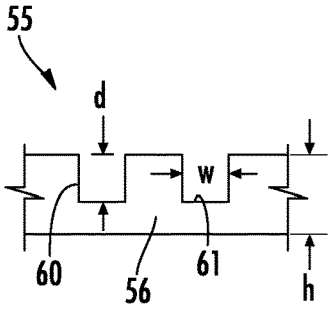
FIG. 4A is a close-up perspective view of the pair of open channels formed in the ribbon of FIG. 4 according to an example embodiment.
Figure 5:
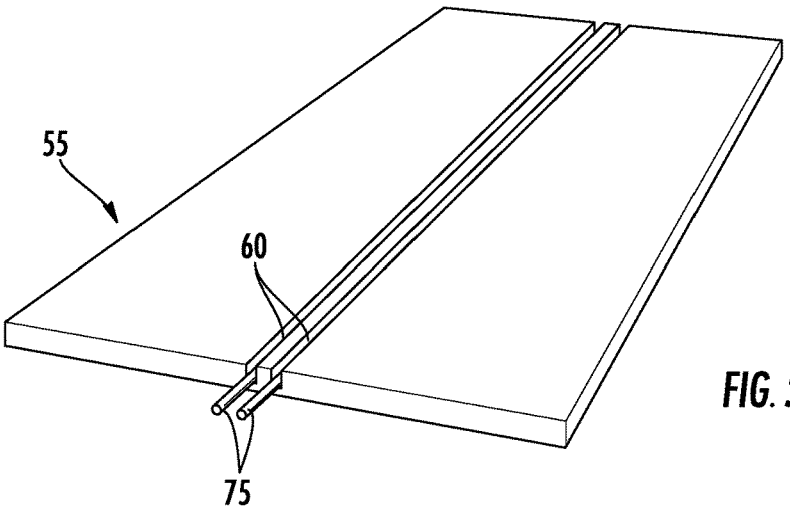
FIG. 5 is a perspective view of the insulative body portion of FIG. 4 after the pair of conductive wires is disposed within the pair of open channels according to an example embodiment.

As noted above, a pair of open channels 60 may be defined along a length of the ribbon of material 56 to form the insulative body portion 55, as shown in FIG. 4. The open channels 60 may be defined through one of the outer longitudinal surfaces 65 of the insulative body portion 55, such that a depth d of each channel is less than the height h of the ribbon of material 56 from which the insulative body portion 55 is formed (see FIG. 4A). The pair of open channels 60 are defined parallel to each other along the length of the ribbon 56, such that when the pair of conductive wires 75 is inserted into the open channels, as shown in FIG. 5, the conductive wires run parallel to each other from one end of the insulative body portion 55 to the other. The pair of conductive wires 75 may be, for example, a pair of single wires made of copper, silver coated copper wire, or other conductive material, and in some cases may be a pair of wire bundles.

In some embodiments, the width w of each channel 60 (FIG. 4A) may be sized to be slightly smaller than a diameter of the conductive wire 75 placed into the channel. In this way, each conductive wire 75 may engage the respective open channel 60 via a friction fit, requiring a certain amount of force to push the conductive wire into its channel. Once the conductive wire 75 is placed within its open channel 60, such that the conductive wire is in contact with a base 61 of its channel, the conductive wire can be held in place via friction.

Figure 6:
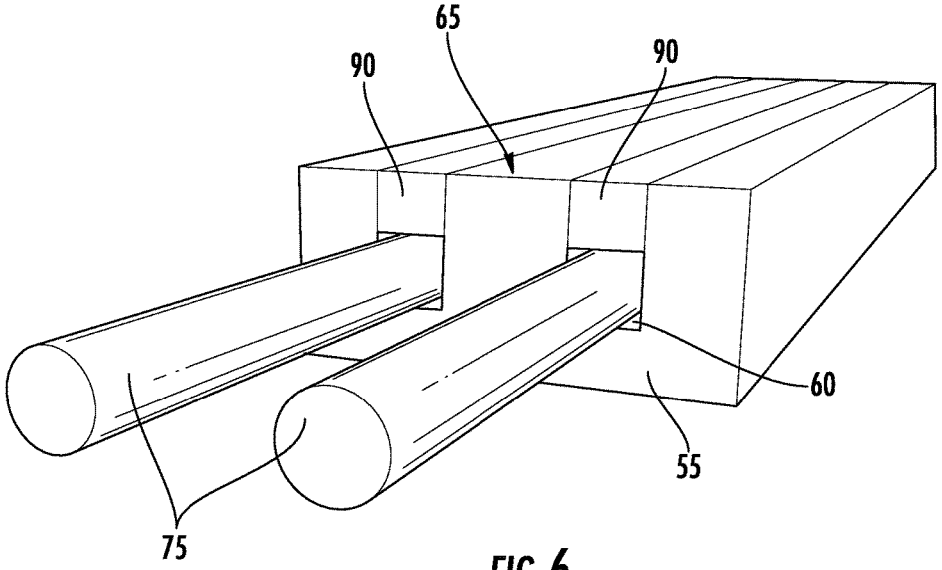
FIG. 6 is a perspective view of the insulative body portion of FIG. 5 showing a pair of channel caps disposed within the open channels according to an example embodiment.

After the conductive wires 75 have been disposed within the open channels 60, the ribbon of material 56 may be trimmed on either side of the pair of open channels and corresponding wires, as shown in FIG. 6. Moreover, a pair of channel caps 90 may be disposed within the pair of open channels 60, respectively, so as to enclose and maintain the pair of conductive wires within the respective open channels. In some cases, the channel caps 90 may be strips of insulative material (e.g., strips of the ribbon of material 56 or similar material) that are sized and shaped to engage the space above each conductive wire 75 within the respective open channel. The channel caps 90 may, for example, have a rectangular cross-section, as illustrated in FIG. 6, and may be configured to provide a flush outer longitudinal surface of the insulative body 55 once engaged within the open channels 60. Accordingly, each channel cap may be configured to engage the respective open channel via a friction fit. In other embodiments, however, the cross-section of the channel caps 90 may not be rectangular and may not match the shape of the open channels. For example, in some cases, each channel cap may comprise a polymer non-conductive wire having a circular cross-section (see FIG. 9). The polymer non-conductive wire may have a diameter configured to engage a width of the respective channel (FIG. 4A) and an available depth of the channel (e.g., after insertion of the conductive element 75), such that the channel cap engages the respective open channel via a friction fit to maintain the conductive wire within the open channel, as described above. In still other cases, however, no channel caps may be used, and the space within the pair of open channels 60 above the pair of conductive wires 75 may be left empty (e.g., with air acting as an insulator).

Figure 7:
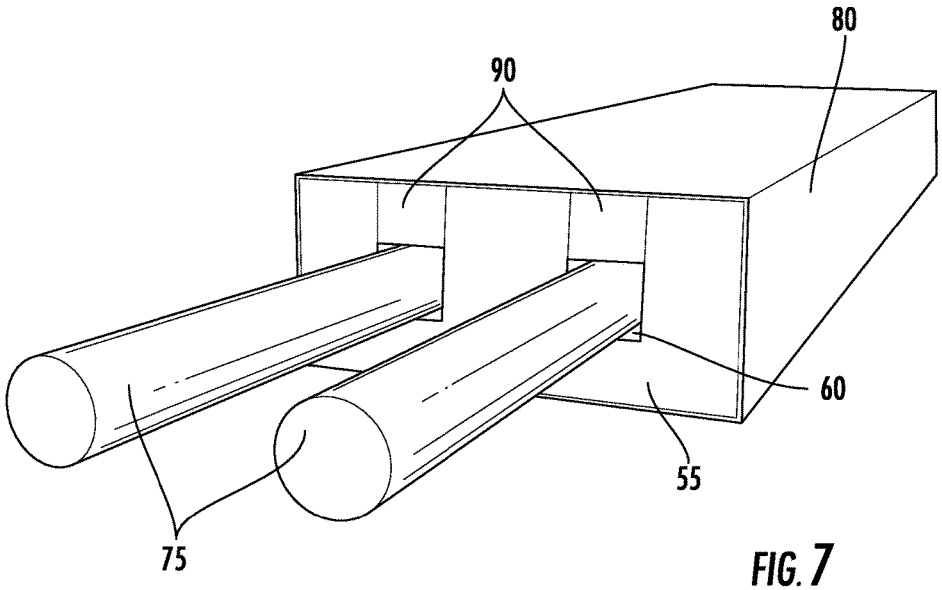
FIG. 7 is a perspective view of the insulative body portion of FIG. 6 showing a conductive sheet wrapped around the insulative body portion according to an example embodiment.

With reference now to FIG. 7, a conductive sheet 80 may be wrapped around the insulative body portion 55. The conductive sheet 80 may thus act as an electromagnetic shield for the cable structure. For example, the conductive sheet 80 may comprise aluminum foil, copper foil, and/or a conductive metal-coated polymer film, such as a polymer film coated with aluminum, copper, silver, or other conductive material. Additionally or alternatively, in some embodiments, the conductive sheet 80 may comprise a sheath of braided wires.

Figure 8:
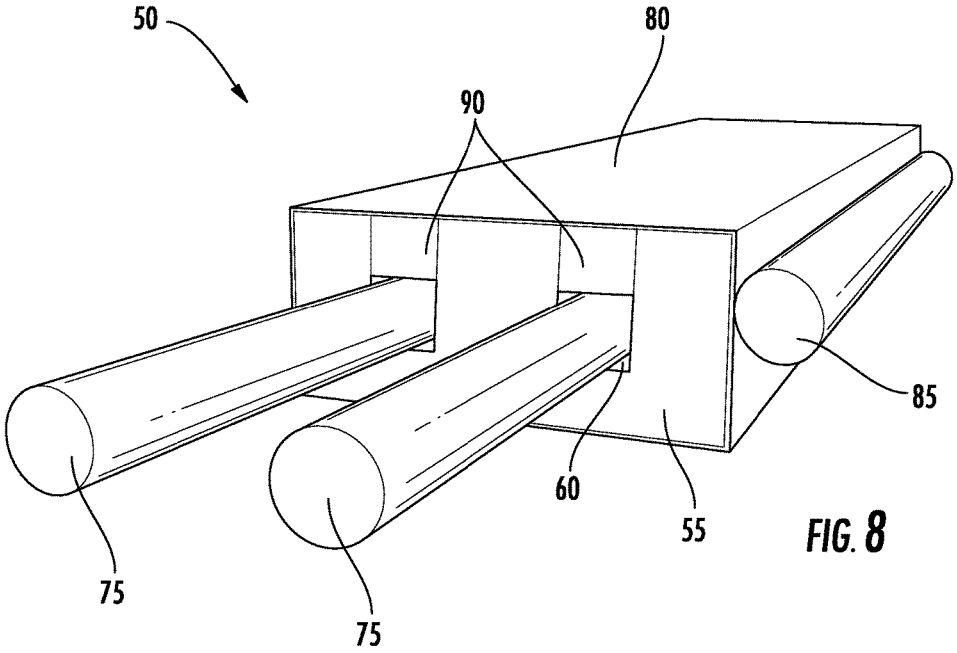
FIG. 8 is a perspective view of the insulative body portion of FIG. 7 showing a grounding element applied to the outside of the conductive sheet according to an example embodiment.

To connect the conductive sheet 80 to ground, a grounding element 85 may be placed into contact with the conductive sheet. The grounding element 85 may establish an efficient, low resistance path to ground, providing shielding from external noise and reducing the emitted noise for the pair of conductive wires 75, thereby promoting a stable and well-defined impedance of the cable structure. The grounding element 85 may, for example, be disposed against an outer surface of the conductive sheet 80, as illustrated in FIG. 8. In other embodiments, such as shown in FIG. 9, the grounding element 85 may be disposed against an outer surface of the insulative body portion 55 and the conductive sheet 80 may be wrapped around the insulative body portion and the grounding element, such that the grounding element is between the insulative body portion and the conductive sheet.

Figure 9:
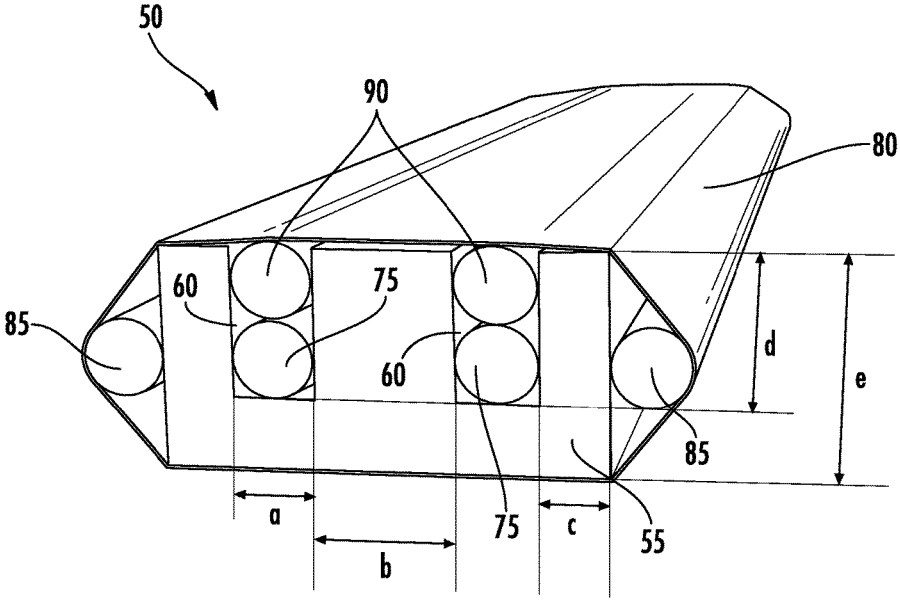
FIG. 9 is a perspective view of the insulative body portion of FIG. 7 showing a grounding element applied to the inside of the conductive sheet according to another example embodiment.

In some embodiments, such as those depicted in FIGS. 8 and 9, the grounding element 85 may comprise at least one ground wire. For example, in FIG. 8, the grounding element 85 comprises a single ground wire, whereas in FIG. 9, the grounding element comprises two ground wires, with one ground wire on each side of the insulative body portion.

Figure 10:
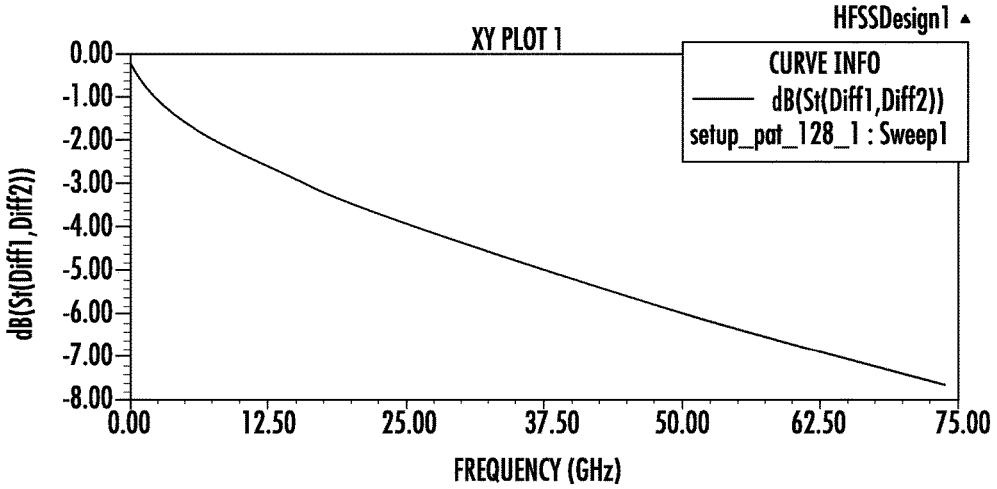
FIG. 10 shows a transmission graph illustrating properties of a cable structure configured according to the configuration shown in FIG. 9 according to an example embodiment.

Using the configuration illustrated in the embodiment of FIG. 9, the behavior of the depicted cable structure having dimensions as provided in Table 2 below was modeled by the inventor using ANSYS SFSS modeler for calculating transmission parameters at high frequency. The resulting transmission graph showing signal losses as a function of transmission frequency is provided in FIG. 10.

TABLE 2

| Dimension | Value (mm) |
|---|---|
| a | 0.4 |
| b | 0.7 |
| c | 0.35 |
| d | 0.75 |
| e | 1.1 |

Figure 11:
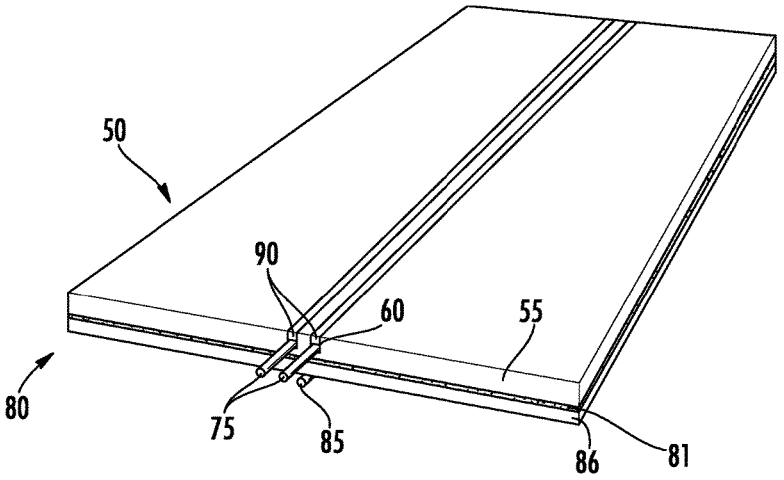
FIG. 11 is a perspective view of an insulative body portion with a planar conductive sheet and a grounding element on one side of the insulative body portion according to another example embodiment.

Turning now to FIG. 11, in some embodiments, the conductive sheet 80 may comprise a planar conductive sheet 86 disposed on one side of the insulative body portion 55, and the grounding element 85 may be disposed on an outer surface of the planar conductive sheet 86. The planar conductive sheet 86 may, for example, be fixed to a bottom surface of the insulative body portion 55, such as via an adhesive layer 81. As noted above with respect to other embodiments, the planar conductive sheet 86 may be a metal foil or a metallized film.

Figure 12:
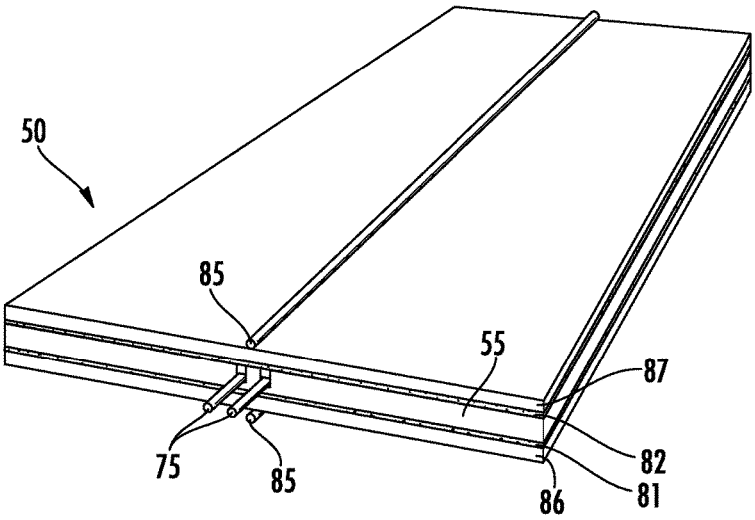
FIG. 12 is a perspective view of an insulative body portion with first and second planar conductive sheets and first and second grounding element applied thereto according to another example embodiment.

To provide shielding and grounding with respect to both the bottom and top surfaces of the cable structure, in some embodiments, the conductive sheet comprises a first planar conductive sheet 86 and a second planar conductive sheet 87. The first planar conductive sheet 86 may be disposed on a first side of the insulative body portion 55 via an adhesive layer 81, and the second planar conductive sheet 87 may be disposed on a second side of the insulative body portion, opposite the first side, via an adhesive layer 82, as shown in FIG. 12. The grounding element 85 may similarly comprise a first grounding element 85 disposed on an outer surface of the first planar conductive sheet 86 and a second grounding element 85 disposed on an outer surface of the second planar conductive sheet 87, opposite the outer surface of the first planar conductive sheet. For example, as shown in FIG. 12, the first planar conductive sheet 86 and the first grounding element 85 may be disposed on a bottom side of the insulative body portion 55, and the second planar conductive sheet 87 and the second grounding element 85 may be disposed on a top side of the insulative body portion.

Figure 13:
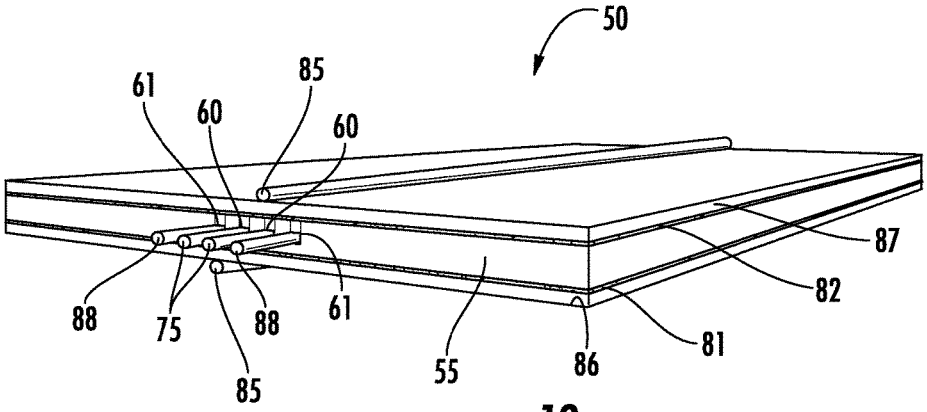
FIG. 13 is a perspective view of the cable structure of FIG. 12 having first and second ground wires on either side of the pair of conductive wires according to an example embodiment.

In still other embodiments, additional shielding of the pair of conductive wires 75 may be provided on the lateral sides of the pair of conductive wires, as well. Referring to FIG. 13, for example, the insulative body portion may define two pairs of open channels 60, 61 comprising a central pair of open channels 60 and an outer pair of open channels 61. In this regard, the conductive wires 75 may be disposed in the central pair of open channels 60, and first and second ground wires 88 may be disposed in the outer pair of open channels 61, such that the first ground wire is disposed on one side of the pair of conductive wires 75 and the second ground wire is disposed on the other side of the pair of conductive wires. The presence of the first and second ground wires 88, in combination with the first and second grounding elements 85, may further reduce the extent that electromagnetic radiation from the external environment affects the signal propagated via the pair of conductive wires 75 as well as the extent that electromagnetic radiation from the signals themselves is passed to the external environment. The first and second ground wires 88 may, in some cases, be identical in size, shape, and material to the pair of conductive wires 75 and/or the first and second grounding elements 85. In other cases, the first and second ground wires 88 may have a different diameter, and/or they may comprise either a solid wire or a bundle of wires (e.g., a plurality of wires that are disposed in each open channel of the outer pair of open channels 61).

Figure 14:
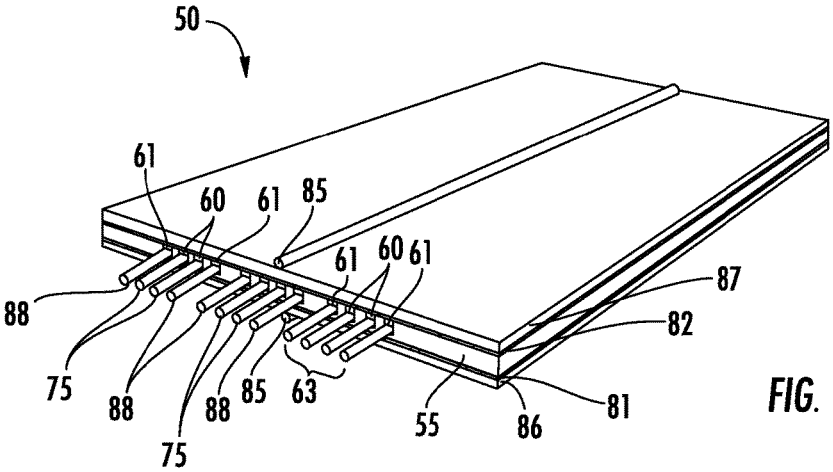
FIG. 14 is a perspective view of the cable structure of FIG. 13 having multiple sets of conductive wires and ground wires according to an example embodiment.

Notably, providing shielding via ground wires and grounding elements that effectively surround the pair of conductive wires 75 (e.g., top, bottom, and sides) may allow for multiple sets of conductive wire pairs to be included in a given ribbon of material forming the insulative body portion. For example, with reference to FIG. 14, the insulative body portion 55 may define a plurality of pairs of open channels 60, 61, where each two pairs of open channels comprise a central pair of open channels 60 and an outer pair of open channels 61. The central pairs of open channels 60 may have conductive wires 75 disposed therein, and the outer pair of open channels 61 may have first and second ground wires 88 disposed therein. In this way, each central pair of channels 60 along with its respective outer pair of open channels 61 and the conductive wires 75 and ground wires 88 disposed therein may be considered a set 63, and a single insulative body portion 55 may thus include multiple sets 63 for propagating multiple signal pairs therethrough.

Accordingly, as described above and with reference to FIG. 15, a method of manufacturing a cable structure for transmitting a differential signal is provided that comprises cutting a pair of open channels through an outer longitudinal surface of a ribbon of material to form an insulative body portion (Block 100) and inserting a pair of conductive wires within the pair of open channels (Block 110). As described above, the channels are parallel to each other and extend a length of the insulative body portion, and the pair of conductive wires is configured to collectively transmit a differential signal. A conductive sheet may be disposed on the insulative body portion at Block 120, where the conductive sheet is configured to shield the pair of conductive wires. Furthermore, a grounding element may be placed in contact with the conductive sheet at Block 130, where the grounding element is configured to conduct electric current away from the conductive sheet. In some cases, the pair of conductive wires may be enclosed within the pair of open channels by placing a pair of channel caps into the pair of open channels at Block 140, although in other cases no channel caps may be used, leaving the space above the conductive wires empty (e.g., the air in that space acting as an insulator).

As described above with respect to FIGS. 2-14, in some cases disposing the conductive sheet on the insulative body portion may comprise wrapping the conductive sheet around the insulative body portion, and placing the grounding element in contact with the conductive sheet may comprise disposing the grounding element against an outer surface of the conductive sheet. In some embodiments, placing the grounding element in contact with the conductive sheet may comprise disposing the grounding element against an outer surface of the insulative body portion, and disposing the conductive sheet on the insulative body portion may comprise wrapping the conductive sheet around the insulative body portion and the grounding element.

In still other embodiments, disposing the conductive sheet may comprise adhering a first planar conductive sheet onto a first side of the insulative body portion and adhering a second planar conductive sheet onto a second side of the insulative body portion, opposite the first side, as depicted in FIG. 12. Similarly, placing the grounding element may comprise applying a first grounding element onto an outer surface of the first planar conductive sheet and applying a second grounding element onto an outer surface of the second planar conductive sheet, opposite the outer surface of the first planar conductive sheet.

As described above with reference to FIG. 13, cutting a pair of open channels may comprise cutting two pairs of open channels comprising a central pair of open channels and an outer pair of open channels, and inserting a pair of conductive wires may comprise inserting a pair of conductive wires in the central pair of open channels. Thus, the method may further include inserting first and second ground wires in the outer pair of open channels, such that the first ground wire is disposed on one side of the pair of conductive wires and the second ground wire is disposed on the other side of the pair of conductive wires.

Moreover, in some embodiments, cutting a pair of open channels may comprise cutting a plurality of pairs of open channels comprising central pairs of open channels and outer pairs of open channels, and inserting a pair of conductive wires may comprise inserting a pair of conductive wires in each central pair of open channels. The method may further include inserting first and second ground wires in each outer pair of open channels, such that each first ground wire is disposed on one side of a respective pair of conductive wires and each second ground wire is disposed on the other side of the respective pair of conductive wires.

Figure 15:
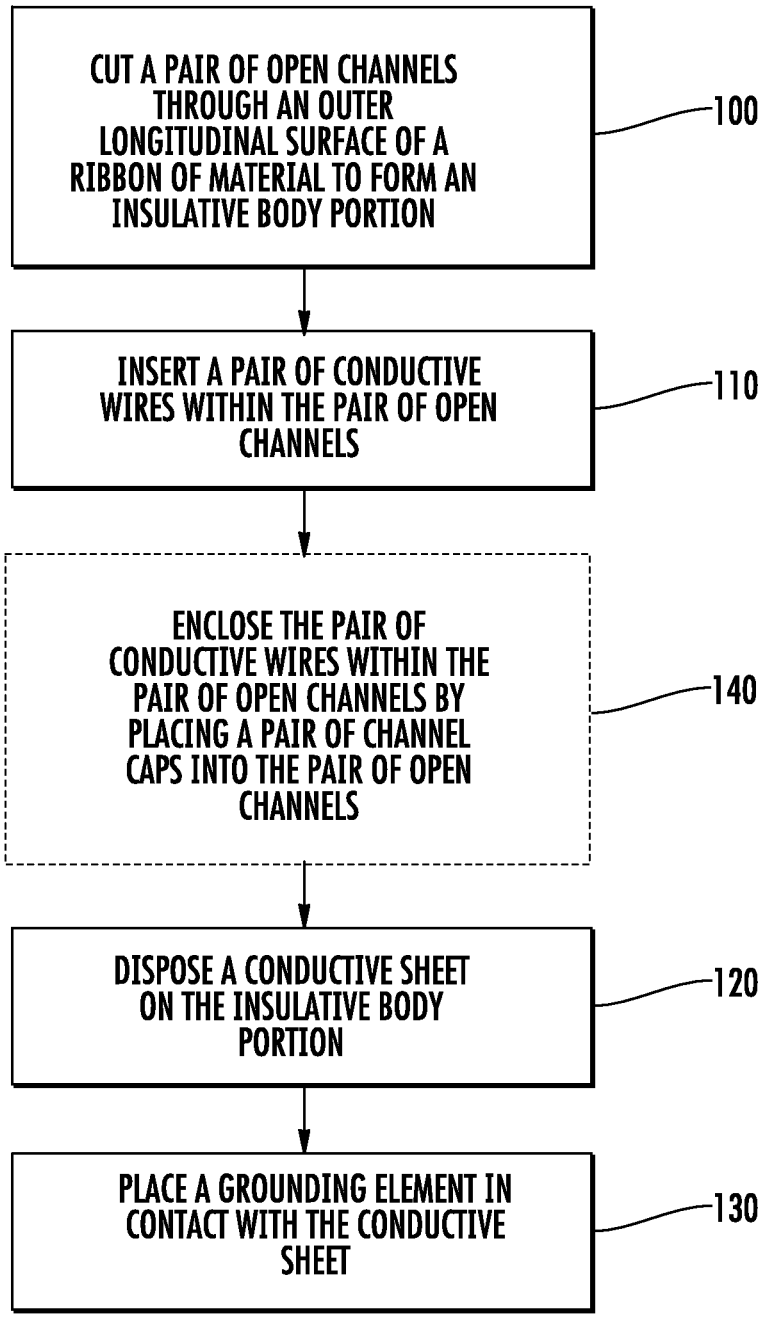
FIG. 15 illustrates a flowchart of methods of manufacturing a cable structure for transmitting a differential signal according to an example embodiment.

In some embodiments, certain ones of the operations or processes described above may be modified or adjusted depending on the application or the particular user preferences. Furthermore, in some embodiments, additional optional operations or processes may be included, one of which is shown in FIG. 15 using dashed lines. Although the operations described above are shown in a certain order in FIG. 15, certain operations may be performed in any order. In addition, modifications, additions, or amplifications to the operations above may be performed in any order and in any combination.

Figure 16:
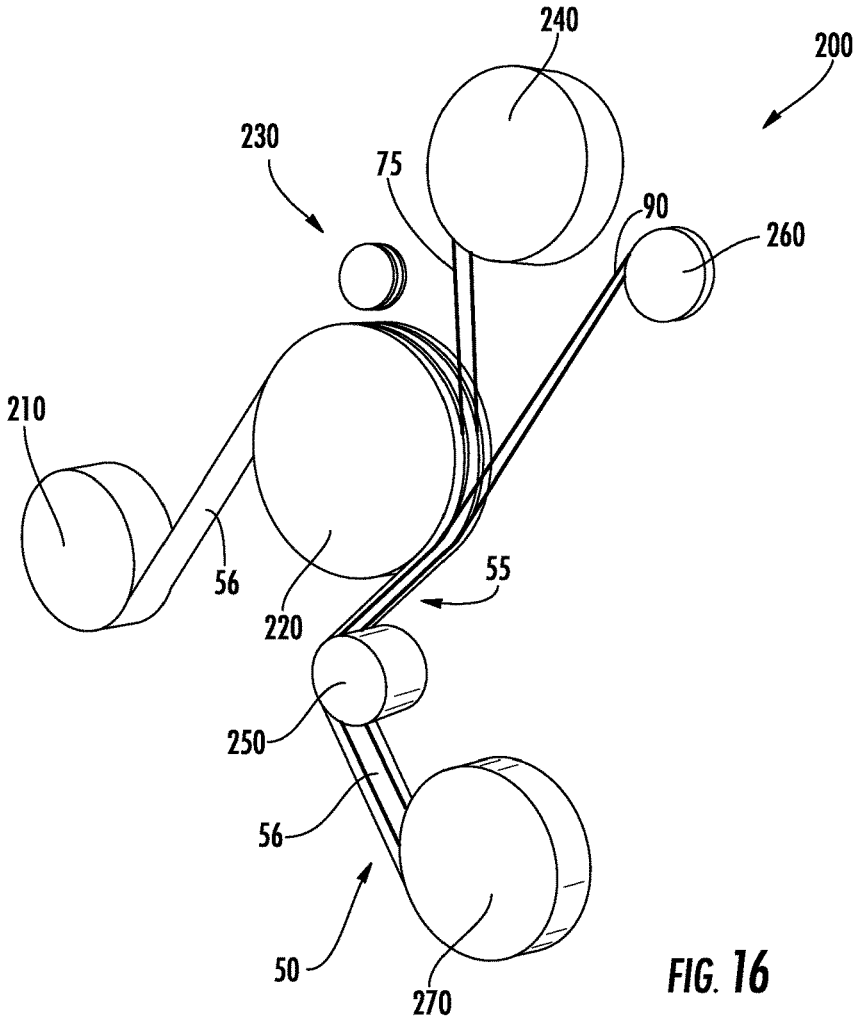
FIG. 16 illustrates a schematic view of an apparatus for manufacturing a cable structure for transmitting a differential signal according to an example embodiment.
Figure 17:
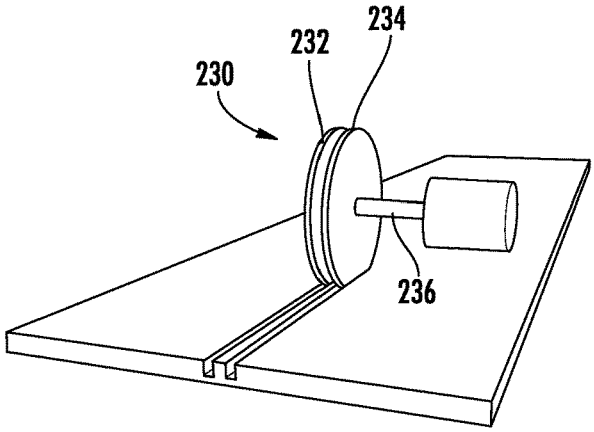
FIG. 17 is a close-up schematic view of a cutting element of the apparatus of FIG. 16 according to an example embodiment.
Figure 18A:
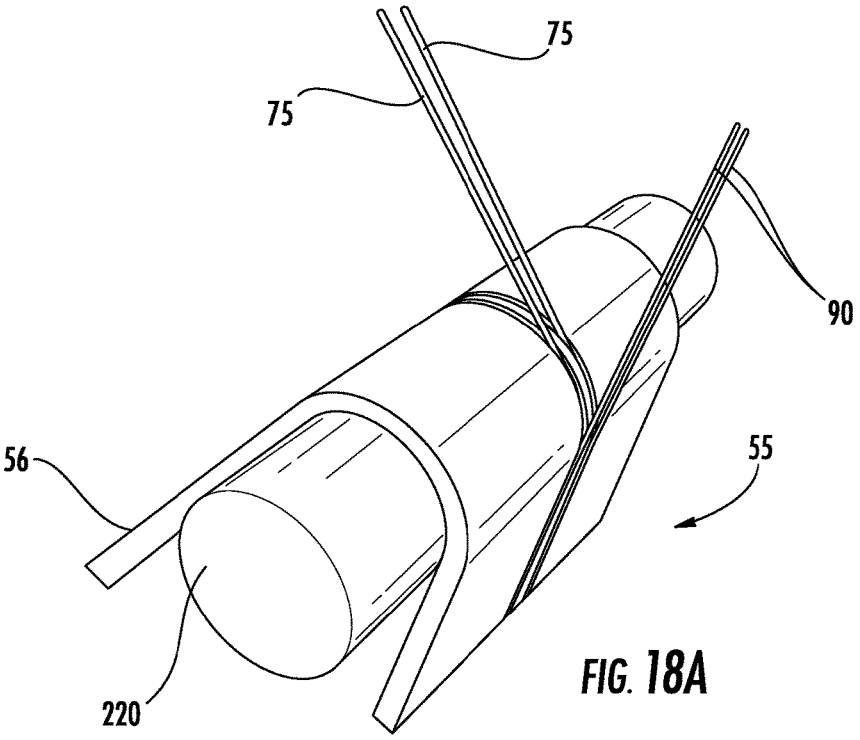
FIG. 18A is a close-up schematic view of the second spool of the apparatus of FIG. 16 from a top side of the apparatus according to an example embodiment.
Figure 18B:
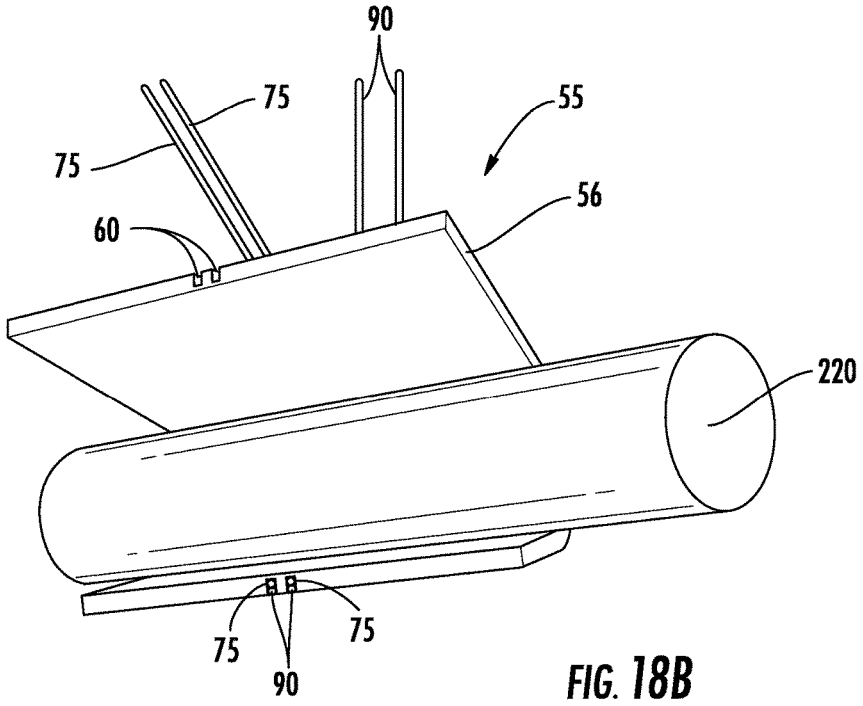
FIG. 18B is a close-up schematic view of the second spool of the apparatus of FIG. 16 from a bottom side of the apparatus according to an example embodiment.

With reference now to FIGS. 16-18B, an apparatus 200 is described for manufacturing a cable structure for transmitting a differential signal. As shown in FIG. 16, the apparatus 200 may comprise a first spool 210 configured to hold a supply of ribbon 56 and a second spool 220 configured to support a portion of the ribbon 56 received from the first spool. The apparatus 200 may further comprise a cutting element 230 that is configured to cut a pair of open channels through an outer longitudinal surface of the portion of ribbon 56 supported by the second spool 220 to form an insulative body portion of a cable structure. The cutting element 230 may comprise two rotary cutting blades 232, 234 supported by a motor shaft 236, as shown in FIG. 17. The blades 232, 234 may be placed above the second spool 220 on a fixture (not shown) that allows the blades to be accurately placed at the required height above the second spool to form the open channels at the right locations and to the correct depths for subsequent placement of the conductive wires 75. The blades 232, 234, which may be two or four or more blades, according to the desired configuration of the cable structure, may be made of a material suitable for cutting through the selected material of the insulative body portion (e.g., the ribbon material). Accurate distances between blades may be maintained by inserting appropriately-sized spacers between the blades on the motor shaft 236 driving the blades, such as done in a process known as "gang sawing." Moreover, although two blades are shown in FIG. 17, the apparatus 200 may include a single blade cutting element, multiple single blades aligned separately, or a multiple blade "gang saw" cutting element with two or more blades separated by spacers as described above to ensure accurate spacing between the open channels.

The apparatus 200 may also include a third spool 240 downstream of the second spool 220 that is configured to provide a supply of conductive wire 75. In this way, a pair of conductive wires may be inserted (e.g., pressed) within the pair of open channels of the insulative body portion formed from the ribbon 56, as shown in greater detail in FIGS. 18A and 18B.

In some embodiments, the apparatus 200 may comprise a tensioning element 250 configured to apply tension to a portion of the ribbon received from the second spool, where the amount of tension applied to the portion of the ribbon facilitates insertion of the pair of conductive wires within the pair of open channels. For example, the tensioning element 250 may be positioned so as to apply greater tension to the ribbon 56 at a portion of the ribbon where the conductive wires 75 are in place within the open channels (e.g., by pushing against the ribbon downstream of the second spool 220 to a greater extent), and in turn that tension may be applied via the ribbon to the conductive wires 75 as they are being disposed within the open channels upstream of the tensioning element 250, as illustrated in FIG. 16.

In still other embodiments, the apparatus 200 may further comprise a fourth spool 260 that is configured to provide a supply of channel caps 90 for insertion within the pair of open channels of the insulative body portion formed by the ribbon 56 following insertion of the pair of conductive wires 75, so as to enclose and maintain the pair of conductive wires within the respective open channels. In some cases, the apparatus 200 may further comprise a coating station (not shown) downstream of the second spool 220, such as at the tensioning element 250, configured to apply a protective surface to the insulative body portion following insertion of the pair of conductive wires 75. The protective surface may be applied to the cable structure 50 using an adhesive. The cable structure 50 may be wound about a take-up spool 270 of the apparatus 200 at the end of the processing steps for storage and/or shipment and/or may be stored on the take-up spool pending further processing using another apparatus or mechanism. Additional processing stations may be added between the tensioning element 250 and the take-up spool 270, as needed depending on the particular application and specifications for the resulting cable structure 50. For example, additional stations may be included in the apparatus 200 for applying first and second grounding elements 85 and/or first and second ground wires 88 (shown in FIG. 14).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of manufacturing a cable structure for transmitting a differential signal comprising:

cutting a pair of open channels through an outer longitudinal surface of a ribbon of material to form an insulative body portion, wherein the channels are parallel to each other and extend a length of the insulative body portion;

inserting within each open channel of the pair of open channels a conductive wire, wherein the conductive wires of the pair of open channels form a pair of conductive wires configured to collectively transmit a differential signal;

disposing a conductive sheet on the insulative body portion, wherein the conductive sheet is configured to shield the pair of conductive wires; and placing a grounding element in contact with the conductive sheet, wherein the grounding element is configured to conduct electric current away from the conductive sheet.

2. The method of claim 1 further comprising enclosing the pair of conductive wires within the pair of open channels by placing a pair of channel caps into the pair of open channels.

3. The method of claim 1, wherein disposing the conductive sheet on the insulative body portion comprises wrapping the conductive sheet around the insulative body portion, and wherein placing the grounding element in contact with the conductive sheet comprises disposing the grounding element against an outer surface of the conductive sheet.

4. The method of claim 1, wherein placing the grounding element in contact with the conductive sheet comprises disposing the grounding element against an outer surface of the insulative body portion, and wherein disposing the conductive sheet on the insulative body portion comprises wrapping the conductive sheet around the insulative body portion and the grounding element.

5. The method of claim 1, wherein disposing the conductive sheet comprises adhering a first planar conductive sheet onto a first side of the insulative body portion and adhering a second planar conductive sheet onto a second side of the insulative body portion, opposite the first side, and wherein placing the grounding element comprises applying a first grounding element onto an outer surface of the first planar conductive sheet and applying a second grounding element onto an outer surface of the second planar conductive sheet, opposite the outer surface of the first planar conductive sheet.

6. The method of claim 5, wherein cutting the pair of open channels comprises cutting two pairs of open channels comprising a central pair of open channels and an outer pair of open channels, wherein inserting the pair of conductive wires comprises inserting a pair of conductive wires in the central pair of open channels, the method further comprising inserting first and second ground wires in the outer pair of open channels, such that the first ground wire is disposed on one side of the pair of conductive wires and the second ground wire is disposed on the other side of the pair of conductive wires.

7. The method of claim 5, wherein cutting the pair of open channels comprises cutting a plurality of pairs of open channels comprising central pairs of open channels and outer pairs of open channels, wherein inserting the pair of conductive wires comprises inserting a pair of conductive wires in each central pair of open channels, the method further comprising inserting first and second ground wires in each outer pair of open channels, such that each first ground wire is disposed on one side of a respective pair of conductive wires and each second ground wire is disposed on the other side of the respective pair of conductive wires.

8. An apparatus for manufacturing a cable structure for transmitting a differential signal, the apparatus comprising:

a first spool configured to hold a supply of ribbon;

a second spool configured to support a portion of the ribbon received from the first spool;

a cutting element configured to cut a pair of open channels through an outer longitudinal surface of the portion of the ribbon supported by the second spool to form an insulative body portion of a cable; and a third spool downstream of the second spool configured to provide a supply of conductive wire, such that a pair of conductive wires is inserted within the pair of open channels of the insulative body portion.

9. The apparatus of claim 8 further comprising:

a tensioning element configured to apply tension to a portion of the ribbon received from the second spool, wherein the amount of tension applied to the portion of the insulative ribbon facilitates insertion of the pair of conductive wires within the pair of open channels.

10. The apparatus of claim 8 further comprising:

a fourth spool configured to provide a supply of channel caps for insertion within the pair of open channels of the insulative body portion, respectively, following insertion of the pair of conductive wires, so as to enclose and maintain the pair of conductive wires within the respective open channels.

11. The apparatus of claim 8 further comprising:

a coating station downstream of the second spool configured to apply a protective surface to the insulative body portion following insertion of the pair of conductive wires.

12. The apparatus of claim 8, wherein the cutting element comprises a plurality of rotary cutting blades supported by a motor shaft.

* * * * *